US009169722B2

(12) United States Patent
DeLange et al.

(10) Patent No.: US 9,169,722 B2
(45) **Date of Patent: *Oct. 27, 2015**

(54) METHODS AND APPARATUS RELATING TO EXPANSION TOOLS FOR TUBULAR STRINGS

(71) Applicant: Weatherford Technology Holdings, LLC, Houston, TX (US)

(72) Inventors: Richard W. DeLange, Kingwood, TX (US); Scott H. Osburn, Conroe, TX (US); Varadaraju Gandikota, Cypress, TX (US); Ghazi J. Hashem, Pasadena, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/227,720

(22) Filed: Mar. 27, 2014

(65) Prior Publication Data

US 2014/0209326 A1 Jul. 31, 2014

Related U.S. Application Data

(63) Continuation of application No. 12/723,860, filed on Mar. 15, 2010, now Pat. No. 8,714,243.

(51) Int. Cl.
*E21B 43/10* (2006.01)

(52) U.S. Cl.
CPC ..... *E21B 43/105* (2013.01); *E21B 43/103* (2013.01); *E21B 43/106* (2013.01); *E21B 43/108* (2013.01)

(58) Field of Classification Search
CPC ... E21B 43/105; E21B 43/103; E21B 43/106; E21B 43/108; E21B 43/10; E21B 17/02
See application file for complete search history.

(56) References Cited

U.S. PATENT DOCUMENTS

| | | | |
|---|---|---|---|
| 5,348,095 | A | 9/1994 | Worrall et al. |
| 6,012,523 | A | 1/2000 | Campbell et al. |
| 6,085,838 | A | 7/2000 | Vercaemer et al. |
| 6,622,797 | B2 | 9/2003 | Sivley, IV |
| 7,191,841 | B2 | 3/2007 | Sivley, IV |
| 7,712,522 | B2 | 5/2010 | Shuster et al. |
| 2004/0055759 | A1 | 3/2004 | Sivley, IV |
| 2007/0205001 | A1 | 9/2007 | Shuster et al. |
| 2007/0277972 | A1 | 12/2007 | Shuster et al. |
| 2009/0229836 | A1 | 9/2009 | Delucia |
| 2010/0044030 | A1 | 2/2010 | Whiddon et al. |

FOREIGN PATENT DOCUMENTS

WO 03036012 A2 5/2003

OTHER PUBLICATIONS

European Search Report for European Application No. 11250303.2, dated Mar. 28, 2014.

*Primary Examiner* — Yong-Suk (Philip) Ro
(74) *Attorney, Agent, or Firm* — Patterson & Sheridan, L.L.P.

(57) ABSTRACT

An expansion tool for use in a wellbore includes an expansion surface made up of a concave portion, a convex portion and a straight section therebetween. The straight section is formed according to a formula Y=(1.26)(X)−0.13, where X is the wall thickness of a tubular and Y is the length of the straight section. The concave portion and the convex portion have an arc length extending the concave portion to a trailing edge of the tool. The concave and convex portions are radius-shaped. The arrangement of the shapes and their relation to each other reduces relatively high and low contact pressures and lessens the effects of axial bending in a tubular or a connection.

11 Claims, 9 Drawing Sheets

METHODS AND APPARATUS RELATING TO EXPANSION TOOLS FOR TUBULAR STRINGS

BACKGROUND OF THE INVENTION

1. Field of the Invention

The present invention relates to expandable tubulars. More particularly, the invention relates to improved apparatus and methods for expanding tubular strings, including tubulars and the connections therebetween. More particularly still, the invention relates to improved apparatus and methods for expanding tubular strings through the use of expansion tools having optimized, shaped surfaces that reduce axial bending forces and damage to threaded connections.

2. Description of the Related Art

Strings of wellbore tubulars are used to line wellbores and to provide a fluid conduit for the collection of hydrocarbons. Typically, a portion of wellbore is formed by drilling and then a string of tubulars (or "liner" or "casing"), is inserted and cemented into the wellbore to prevent cave-in and to isolate the wellbore from a surrounding formation. Because the wellbore is drilled in sections and each section is cased before continuing to drill, each subsequent section is of a smaller diameter than the one above it, resulting in a telescopic arrangement of casing having an ever-decreasing diameter.

Expanding tubulars in a wellbore involves running a string of tubulars in at a first, smaller diameter and then enlarging their diameter once they are set in place. Downhole expansion has always been appealing as a way to partially overcome the limitations brought about by small diameter tubulars. For example, expanding a downhole tubular even slightly results in an enlarged fluid pathway for hydrocarbons and an enlarged pathway for the passage of a subsequent string of tubulars or tools needed for operations downhole. In another example, expandable tubulars can permit troublesome zones in a wellbore to be sealed off by running a section of tubulars into the wellbore and expanding it against the wellbore walls to isolate a formation. In still another example, expandable production tubing could be inserted into a wellbore at a first diameter and then expanded to permit greater capacity for collecting hydrocarbons.

A typical prior art expansion tool is illustrated in U.S. Pat. No. 5,348,095 and that patent is incorporated by reference herein in its entirety. The '095 patent teaches a tool having a conically shaped first end permitting its insertion into a tubular. The mid portion of the tool has an outer diameter substantially larger than the inner diameter of the tubular to be expanded. Through either fluid or mechanical force or a combination thereof, the tool is forced through the tubular, resulting in an increase in the inner and outer diameters of the tubular.

Other prior art patents illustrate techniques for moving an expansion tool through a string of tubulars. For example, U.S. Pat. No. 6,085,838, incorporated herein by reference, illustrates running a section of casing or liner into a wellbore on a work string that includes a conical expansion tool at its lower end. After the section of liner is located in the wellbore and anchored, the work string and expansion tool are moved upwards due to fluid pressure pumped through the work string and acting upon a lower end of the tool. After expanding the length of tubular, the string and expansion tool are removed, leaving the expanded liner in the wellbore.

When a tubular is expanded by moving an expansion tool through it, a frictional force is developed between the contact surface(s) of the tool and the tubular walls in contact with the tool. A radial expansion force is also created as the tubular walls move directly outwards from the centerline of the tubular. Additionally, there is a force developed along the longitudinal axis of the tubular due to the movement of the expansion tool along its length. This "axial bending" force causes the tubing to bend outwards, or flare as the tool "opens" the tubular to a greater diameter. Of the various forces at work during expansion by an expansion tool, axial bending is the most troublesome due to its progressive nature and its tendency to place an inside wall of a tubular into tension and an outer wall into compression as the cone moves along in the expansion process.

FIG. 1 is a graph showing the contact force generated by a prior art, conical expansion tool as it moves through and expands a 5½" diameter section of tubing. The horizontal axis of the graph is the tool's expansion surface measured in inches and the vertical axis is contact pressure between the tool and tubular measured in thousands of pounds per square inch (ksi). The prior art expansion tool has a cone angle of 10 degrees and its frustoconical expansion surface is a relatively short 2". Evident in the graph are two large spikes 101, 102 of contact force. The first spike 101 (exceeding 100 ksi) comes about due to the relatively abrupt meeting of the tool and the tubular and the second 102 results from a termination of the expansion process where the tubular extends over the trailing end of the tool. The inventors have determined that axial bending stresses are the greatest at locations where contact pressures are the highest, especially when those contact pressures are followed by relatively low pressures. In the graph of FIG. 1, the high spikes of contact pressure 101, 102 are adjacent to other areas of pressure 103, 104 so low that the tool is not even in contact with the walls of the tubular.

Axial bending stress developed by the type of tool used to produce the graph of FIG. 1 are especially damaging to connections between expandable tubulars that are expanded as the expansion tool is moved through a tubular string. FIG. 2 illustrates a typical threaded connection 150 between tubulars, like liner or casing (not shown). The connection includes a pin member 152 formed at a threaded section of the first tubular and a box member 154 formed at a threaded section of the second tubular. The threaded sections of the pin member and the box member are tapered and are formed directly into the ends of the tubular. The pin member 152 includes helical threads 153 extending along its length and terminates in a relatively thin "pin nose" portion 158. The box member 154 includes helical threads 155 that are shaped and sized to mate with the helical threads 153 of the pin member during the make-up of the threaded connection 150. The threaded section of the pin member and the box member form a connection of a predetermined integrity intended to provide not only a mechanical connection but rigidity and fluid sealing. For example, at each end of the connection, a non-threaded portion of each piece forms a metal-to-metal seal 156, 157.

Threaded connections between expandable tubulars are difficult to successfully expand because of the axial bending that takes place as an expansion member moves through the connection. For example, when a pin portion of a connector with outwardly facing threads is connected to a corresponding box portion of the connection having inwardly facing threads, the threads experience opposing forces during expansion. Typically, the outwardly facing threads will be in compression while the inwardly facing threads will be in tension. Thereafter, as the largest diameter portion of a conical expander tool moves through the connection, the forces are reversed, with the outwardly facing threads placed into tension and the inwardly facing threads in compression. The result is often a threaded connection that is loosened due to different forces acting upon the parts during expansion.

Another problem relates to "spring back" that can cause a return movement of the relatively thin pin nose. Typically, threaded connections on expandable strings are placed in a wellbore in a "pin up" orientation and then expanded from the bottom upwards towards the surface. In this manner, the pin nose is the last part of the connection to be expanded. In FIG. 2 for example, the connection would be expanded from left to right.

FIG. 3 shows the threaded connection 150 of FIG. 2 after expansion with a conical expansion tool like the one shown in the '095 patent. The threads 153, 155, especially those at each end of the connection, are deformed and no longer fit tightly. The sealing areas 156, 157 are also distorted to a point where there is no longer a metal-to-metal seal formed between the parts. Damage to the threads (and sealing surfaces) is especially pronounced at each end due to the differences in thickness of the connection members towards the end of the connection. In addition to thread damage, the two portions of the connection have shifted axially at a torque shoulder, preventing the connection from remaining tightly connected and resulting in a "thinning" of a cross sectional area of the pin. Visible also is the spring back effect that has caused the pin nose portion 158 of the connection to move towards the center of the tubular. In addition to damaging a connection's sealing ability, the connection of FIG. 3 is so badly damaged it might no longer be able to resist forces tending to loosen or untighten the connection between the tubular members.

While the connection of FIGS. 2 and 3 show a single set of threads between the two tubulars, many expandable connections include a "two-step" thread body with threads of different diameters and little or no taper. While not illustrated, these types of connections suffer from the same problems as those with single threads when expanded by a conical shaped expander tool.

The foregoing problems with expandable tubulars and in particular, expandable connections between tubulars have been addressed by a number of prior art patents. U.S. Pat. No. 6,622,797 for instance, addresses the problem with an expansion tool having discrete segments along its profile, each segment divided by a smaller, radiused segment and resulting in an increase in diameter of the expansion tool. According to the inventors, the discrete portions create separate, discrete locations of contact between the expansion tool and the inner surface of the tubular, resulting in less friction generation and a more efficiently operating expansion process. In fact, separating the contact points necessarily creates spikes in contact forces between the tool and the tubular which can exacerbate problems associated with axial bending. In another exemplary prior art arrangement shown in U.S. Pat. No. 7,191,841, a fluid pathway is provided in the expansion tool in order to increase or decrease the force needed to move the tool through the tubular. While the forces might be adjustable, the patent drawings illustrate that the tubular walls literally "skip" off the surface of the expansion tool, creating spikes of contact pressure as the tool moves.

There is a need therefore, for an expansion tool that can expand a tubular string in a manner that decreases the likelihood of damage due to forces created during the expansion process. There is a further need for an expansion tool that can reduce contact pressures and spikes in contact pressure between the tool and the tubular or connection being expanded. There is a further need for an expansion tool that has a contact surface that can maintain contact with a tubular or connection wall and thus reduce the effects of axial bending.

SUMMARY OF THE INVENTION

An expansion tool for use in a wellbore includes an expansion surface made up of a concave portion, a convex portion and a substantially straight center section therebetween. In one aspect, the center section is formed according to a formula $Y=(1.26)(X)-0.13$, where X is the wall thickness of a tubular and Y is the length of the center section. In another aspect, the expansion surface includes a first concave portion and a convex portion having an arc length extending the concave portion to a trailing edge of the tool. In another embodiment, the concave and convex portions are radius-shaped and are tangent to each other and substantially equal in size. In one embodiment, the tool includes a nose radius to further ensure a gradual transition of shapes acting upon a tubular string. In one aspect, an optimum radius for the concave and convex radius is determined by providing about 65" of radius size per each 1" of tubular wall thickness. The arrangement of the shapes and their relation to each other reduces relatively high and low contact pressures and lessens the effects of axial bending in a tubular or a connection.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
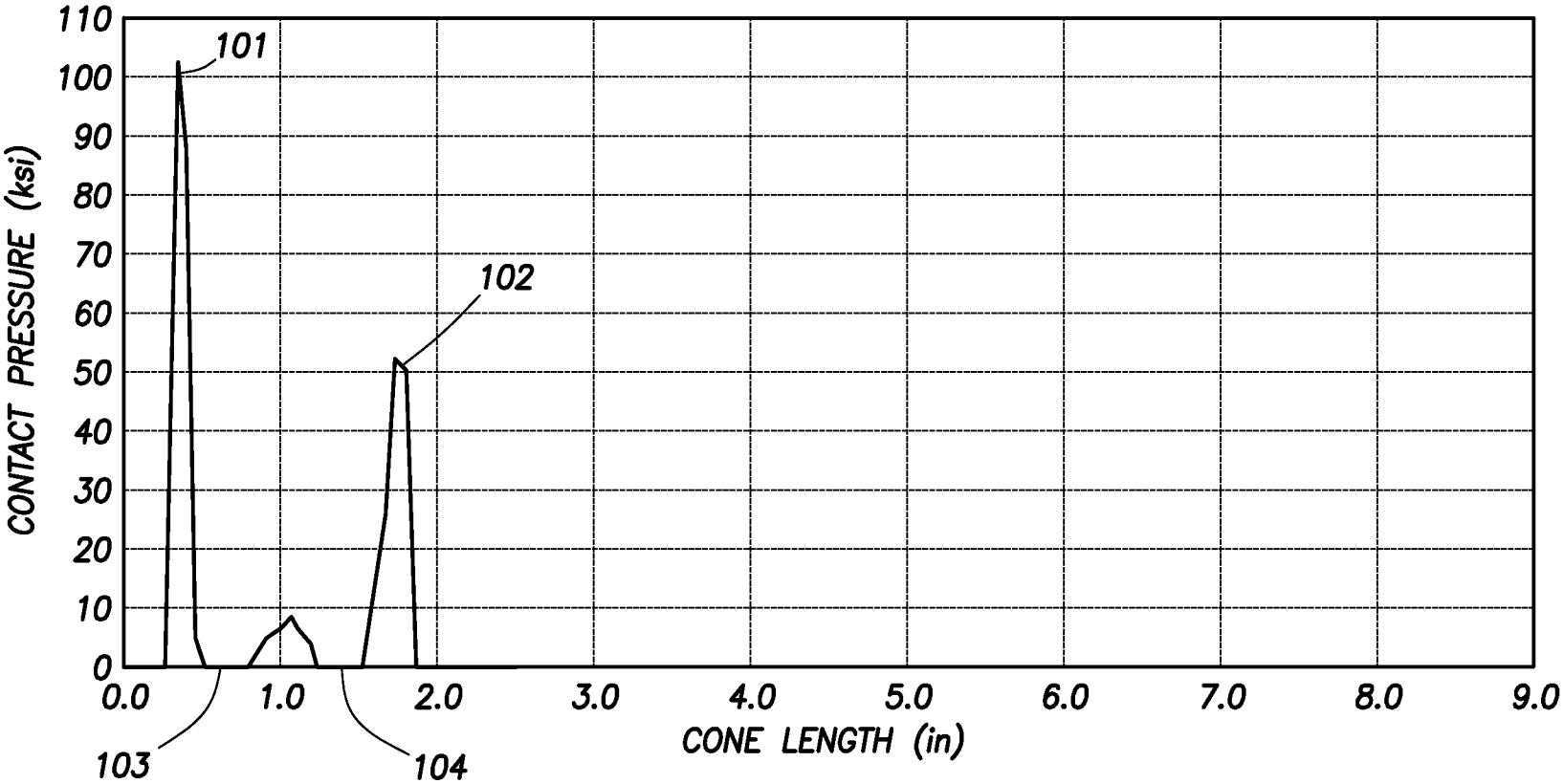
FIG. 1 is a graph illustrating contact pressures between a prior art, conical expansion tool and a tubular.

The inventors have discovered through experimentation and finite element analysis (F.E.A.), a computer-based numerical technique for finding solutions, that tubular threaded connections on expandable oilfield casing and the like which are mechanically expanded with an expansion tool exhibit greater damage from axial bending when the contact forces between the tool and the tubular are concentrated in one or two locations along the tool rather than evenly spaced over the length of an expansion surface of the tool. The inventors have also discovered that rapid changes in contact pressure including relatively high spikes of pressure and areas of little or no pressure result in a greater amount or degree of damage from axial bending forces. The result is a need for an expansion tool that will remain in contact with the tubular/connection as much as possible and one that does not contact the tubular with high forces at any one time but rather, distributes the forces over the length of an expansion surface of the tool. The invention disclosed herein is primarily intended to benefit expandable connections between wellbore tubulars. In this specification the term "tubular", "connection", and "tubular string" are often used interchangeably and any discussion or illustration of problems or benefits associated with a tubular is equally applicable to a connection between tubulars.

In one embodiment of the invention, an expansion tool is provided having an expansion surface with a first concave portion adjacent a first end of the tool and a second convex portion adjacent the concave portion. The portions are equal in size and arc length, tangent to each other at a point where they meet and include a center section therebetween that is tangent, at each end, to one of the portions. In another embodiment the concave and convex portions are radius-shaped and the tool also includes a nose radius at its leading end having a convex radius shape and a trailing end of the tool includes a tail radius that is essentially an extension of the convex radius. In each case, the alternating shapes that make up the expansion surface of the tool are blended together to minimize abruptness and with it, axial bending of a tubular wall or connection during expansion.

The expansion tool of the present invention, while including a number of different concave and convex shapes along its expansion surface, can include a relatively small overall expansion angle without making the expansion surface so long that friction generated between the tool and the tubular or connection requires an excessive expansion force. For example, by utilizing the shapes disclosed herein, expansion tools can be provided with an average expansion angle of as little as 3 or 4 degrees as opposed to a typical expansion angle of 10 degrees. Because the contact pressures are minimized, the overall force needed to move the tool through a tubular string is not significantly increased even though the tool has a longer expansion surface than prior art conical tools. In one example, a tool having radiused expansion surfaces of 20" required a maximum expansion force of 90K lbf. when expanding a 5½" tubular string.

Figure 4:
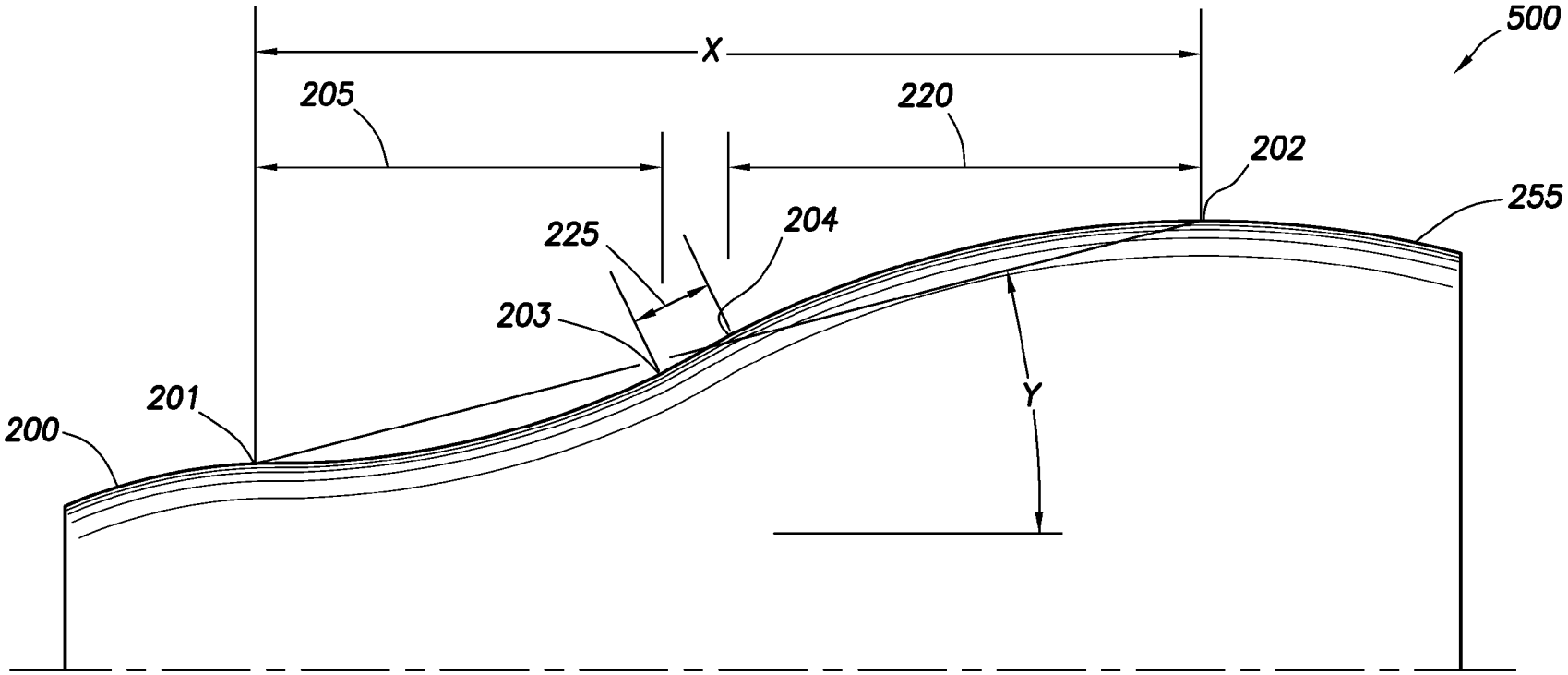
FIG. 4 illustrates a profile of an expansion tool according to one aspect of the present invention.

FIG. 4 illustrates a profile of an expansion tool according to one aspect of the present invention. The shaped expansion surfaces in FIG. 4, including the concave and convex surfaces, are "radiused" surfaces that illustrate one way to ensure that blended and mating shapes work in unison to ensure expansion of a tubular or connection with a minimum of damage. It will be understood however, that there are any number of different geometric shapes that could be used as expansion surfaces so long as they are defined shapes that meet the criteria of providing gradually increasing and decreasing surfaces relative to a centerline of the expansion tool or average expansion angle Y of the expansion tool. For example, the concave and convex shapes could be any smooth curve such as parabolic arcs or elliptical arcs with the angle/severity of the curvature increasing or decreasing along the length of the portion. Such variations are contemplated and are within the scope of the invention.

In the embodiment shown, the tool 500 includes a nose radius 200 which is a convex radius commencing at a leading end of the tool and terminating adjacent a concave expansion radius 205. At its second end, the nose radius terminates at a blend point 201 where the tool surface is parallel to the tubular's center line and at a point where the diameter of the tool 500 is intended to be the same diameter as the smallest inside diameter (ID) of a tubular string to be expanded. In some cases, an inside diameter of the tubulars and the threaded connections therebetween will be equal. In those instances, expansion of each will commence at blend point 201. In other instances, the smallest inner diameter in a string might be within a threaded connection. In those cases, point 201 will be designed to contact the ID of the connections and the larger diameter tubulars will be contacted by the tool at a location further along adjacent expansion radius 205. The tool therefore, is designed to contact and commerce expansion at point 201. An exception to the design criteria occurs when an out-of-round tubular or connection is encountered. In that instance, the nose radius 200 will contact and "round out" a tubular that might be oval in shape when initially encountered in a wellbore. Thereafter, the tubular or connection will be round when encountered by point 201 and the expansion radii 205, 220 thereafter.

The tool of FIG. 4 includes two expansion radii 205, 220. A first radius 205 formed adjacent blend point 201 is a concave radius with an uninterrupted surface tangent to the nose radius and blend point and terminating in a larger diameter end at another blend point 203. A second expansion radius 220 has a convex radius commencing at a blend point 204. Radius 220 has an uninterrupted surface terminating in a larger diameter end at a blend and largest diameter point 202. The radii 205, 220 in the embodiment shown are mirror images of each other, both being the same size (as measured in radius inches), having the same arc length, and both being tangent to one another. The expansion radii 205, 220 are intended to operate together to form an expansion surface (labeled "X") of the tool. At least a portion of the radiused expansion surface X interacts with a tubular wall or connection to cause expansion. However, because changes in the shape and diameter of the expansion surface are gradual, sudden increases and decreases in contact pressure (and resulting axial bending) are reduced. The inventors have determined that steeper expansion angles result in more destructive effects of axial bending so the tool of the invention has been designed to provide an expansion surface with a relatively shallow angle (labeled "Y") as compared to prior art expander tools. The preferred average expansion angle is different for different tubular sizes, wall thicknesses and yield strengths, but for typical applications, an expansion tool according to aspects of the invention can include an effective expansion angle Y of as little as 2 degrees.

Figure 2:
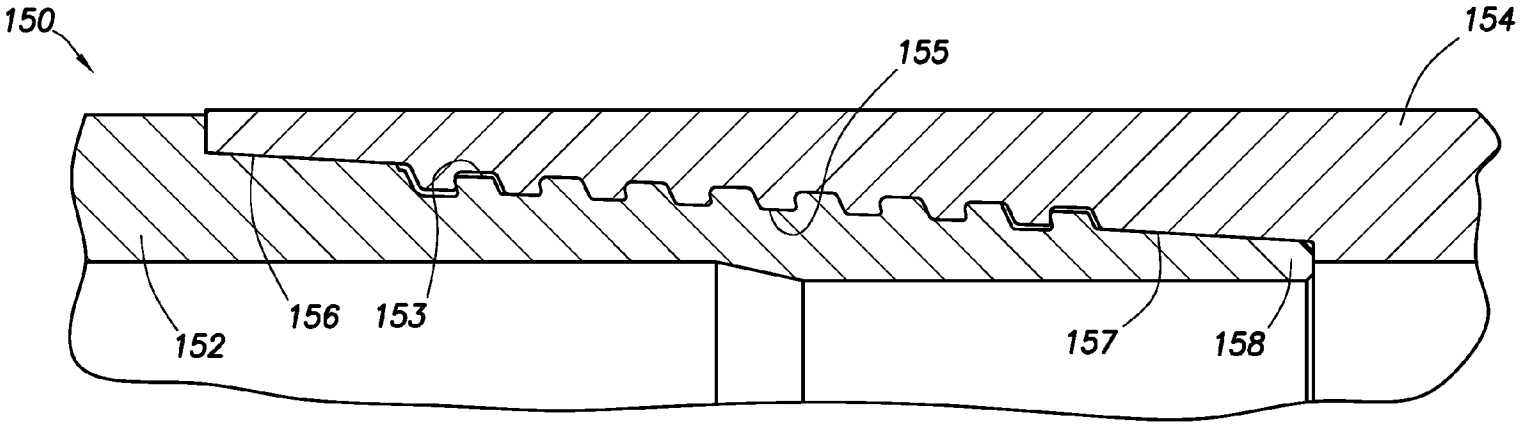
FIG. 2 is a section view of a threaded connection between tubulars prior to being expanded.
Figure 3:
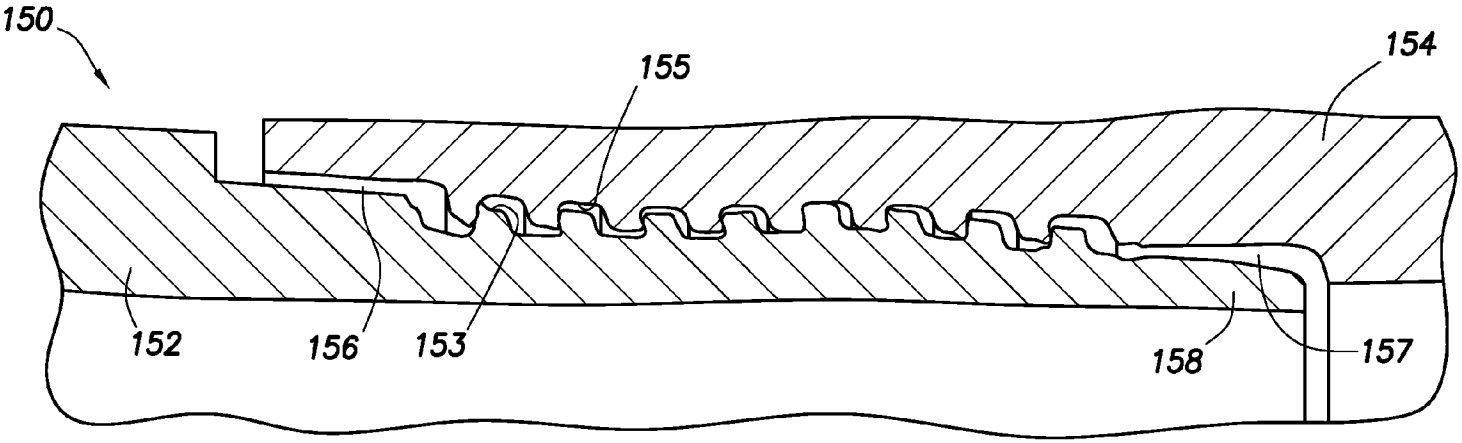
FIG. 3 is the threaded connection of FIG. 2 after expansion with a prior art conical tool.

Finite element analysis has shown that an optimum size for the expansion radii exists for each tubular string to be expanded. The size is determined without consideration of the tubular's outside diameter or grade. Rather, the optimum radius is determined by a tubular's wall thickness and the provision of approximately 65" of radius size per each 1" of wall thickness. This remains true regardless of the overall diameter of the tubular. The guideline ensures a larger, more gradual expansion radius for a thicker-walled tubular. For example, to determine the optimum expansion radius "R" for a wall thickness of 0.304" (which is typical of 5.5" OD wellbore tubulars), the wall thickness "T" is multiplied by 65 (the ratio of expansion to wall thickness, or N) using the calculation: $R=T\times N$. The result is 19.76". Therefore a radius of about 20" is preferable for 5.5" tubular. In another example using a tubular having a 0.582" wall thickness (which is typical for 11.75" OD tubulars), the calculation becomes 0.582 "T" multiplied by 65 "N" or 37.83". Therefore, the preferred radius for 11.75" tubulars is about 40". The inventors have determined that while the thickness of a threaded connection is sometimes slightly different than the tubulars in a string, an expansion tool having an optimum radius for a given tubular wall thickness will also be optimum for integral joint connections like the one shown in FIGS. 2 and 3.

In a preferred embodiment, expansion radii 205, 220 are separated by a center section 225 which is straight, tangent to each radius and blends with each radius at either end 203, 204. Center section 225 provides a neutral area of expansion surface after the first concave expansion radius 205 to permit the expansion forces acting upon the tubular, specifically the axial bending forces, to neutralize prior to contact between the tubular and the convex radius 220. By choosing an appropriately sized center section, any contact pressure spikes between the two opposing radii are reduced while the center section does not add so much area to the expansion surface that it creates excess heat and friction during expansion. In one embodiment, relatively small spikes of contact pressure are created at each end of the center section rather than one larger spike at a transition point between two expansion radii.

More particularly, the center section separates the two expansion surfaces to an extent that the tubular shape is not abruptly reversed. Without a center section or with one that is too short, the tubular shape change requirement is instant, causing a severe contact pressure spike between the tubular and the cone. Along with the pressure spikes, area with virtually no contact between the tool and tubular further exaggerate the spikes of pressure on each side of the low pressure point. In fact, the thicker the tubular wall thickness/stiffness, the more resistant the tubular will be to reversing this shape change and the greater the contact pressure spike. Therefore, the center section is dependent upon wall thickness and its length must be increased for thicker wall thicknesses in order to provide more of a separation between the concave and convex expansion surfaces.

Figure 5:
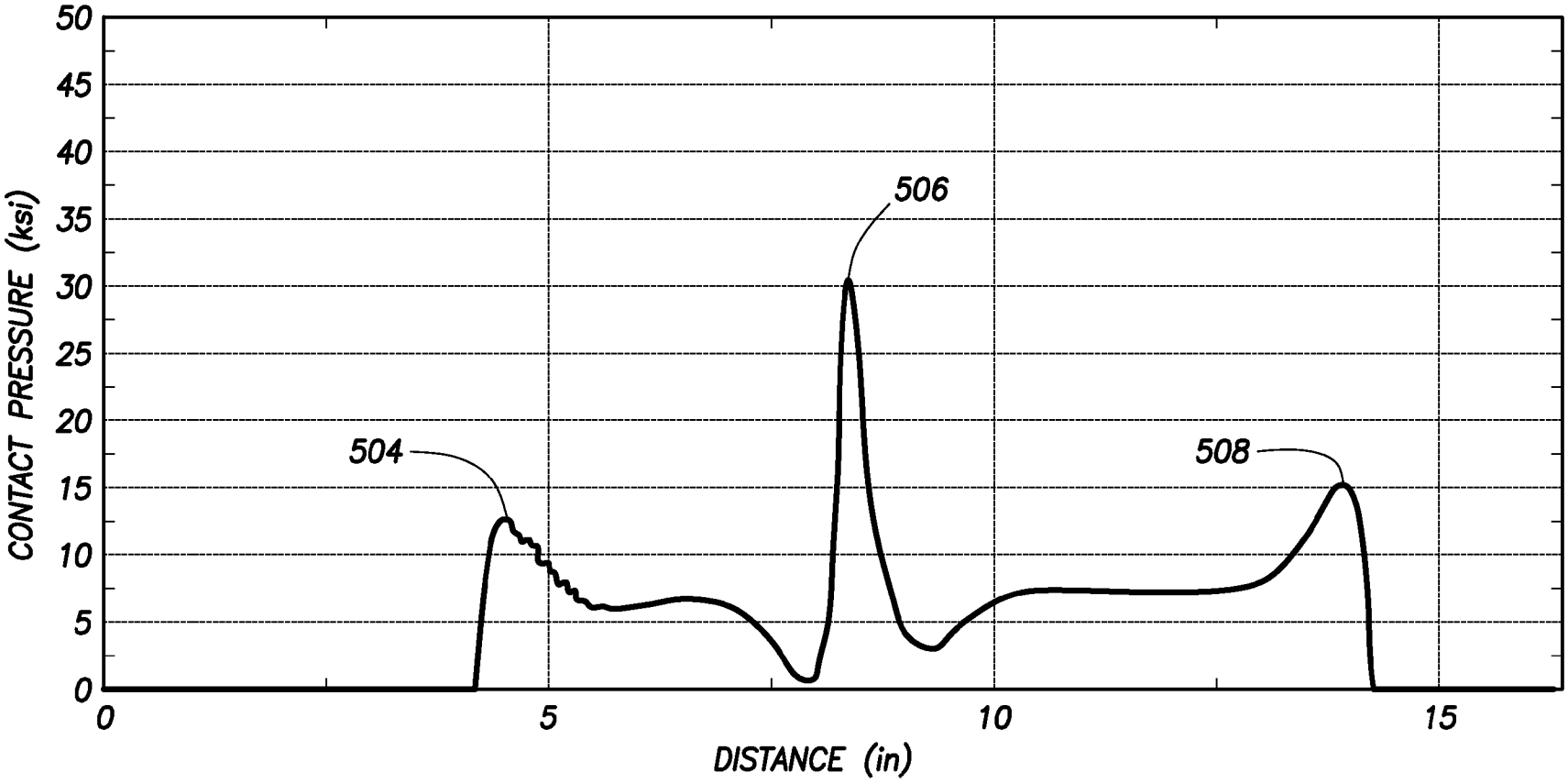
FIG. 5 is a graph showing contact pressures generated by an expansion tool having radiused expansion surfaces with no center section therebetween.

FIG. 5 is a graph showing contact pressure in ksi developed between an expansion tool having radiused expansion surfaces but no center section therebetween. As illustrated, the contact pressure forms a spike 504 where the tool contacts the tubular. At a right side of the graph is another spike 508 where the tool leaves the tubular. A large center spike 506 of up to 30 ksi is formed by the transition from a first convex radius to an opposing concave radius. Without a center section to spread the transition, the large spike is unavoidable.

Analyses have shown that an optimum center section is one with at least enough length to permit the tubular or connection wall to recover or normalize between contact with the opposed convex and concave expansion surfaces. The inventors have found that the following formula, utilizing wall thickness of a tubular or connection, is usable to determine a minimum center section needed to reduce or eliminate spikes in contact pressure during expansion:

$$Y=(1.26)(X)-0.13$$

Where: Y=center section length in inches and; X=pipe wall thickness in inches.

Figure 6:
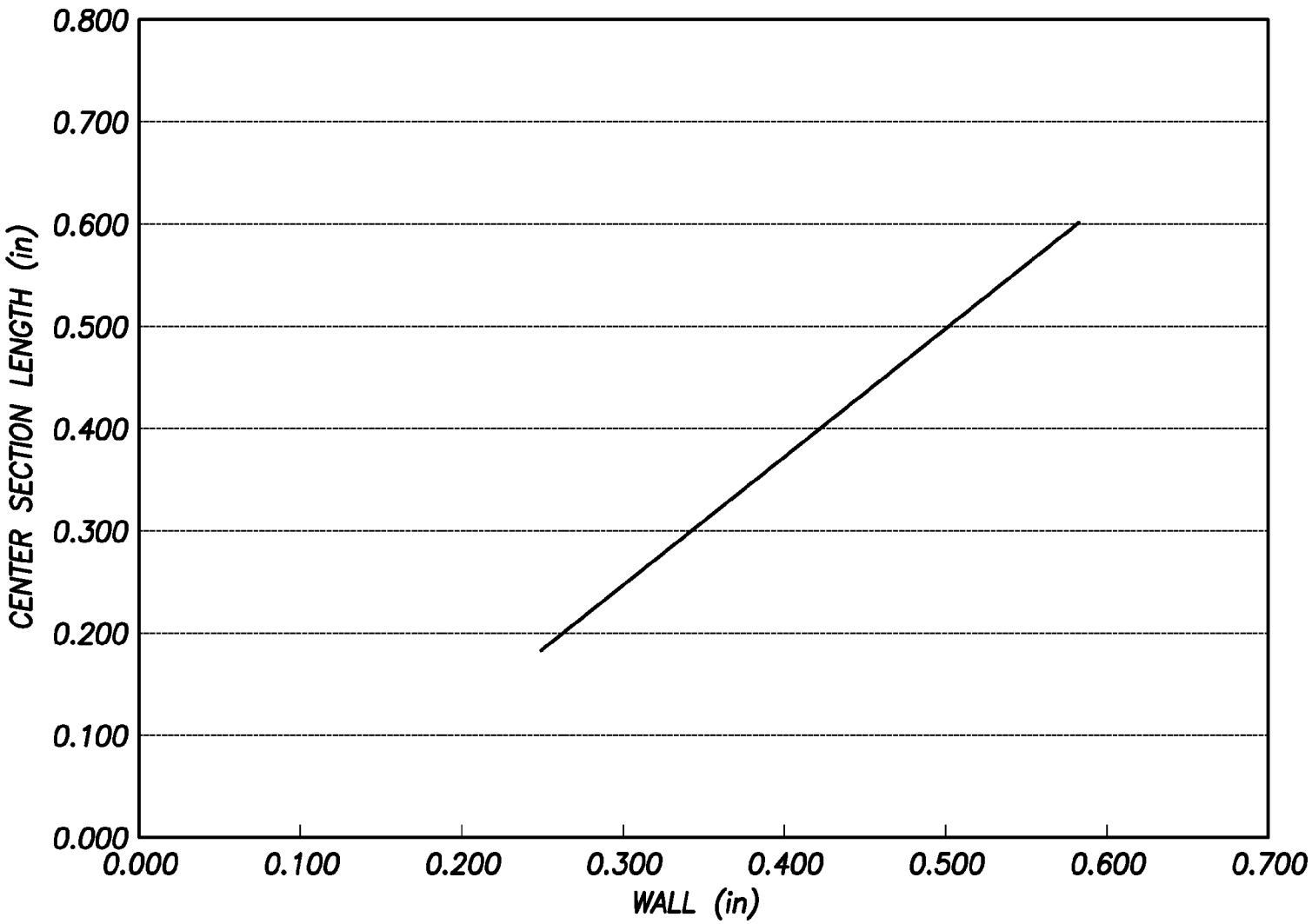
FIG. 6 is a graph showing a minimal, optimal center section length for tubulars having various wall thicknesses.

FIG. 6 makes use of the equation with a line used to determine a minimal length of a center section. Using the formula, an optimum center section can be determined for any size tubular or connection. For instance, using the formula and/or the graph, an optimum length for a center section in a tool designed to expand a 5½" tubular with wall thickness of 0.304" will be: (1.26)(0.304)−0.13=0.25". Therefore, a minimum length for an optimal center section in the example will be about ¼".

The center section 225 of the shaped cone's expansion surface is especially important when avoiding damage to a connection's engaged threads. Because expanded connections are machined on thin wall tubular to keep expansion force requirements in a reasonable range, there can be relatively few threads engaged in a connection at the outset. The number of engaged threads are important to a connection's mechanical strength and when one or more of the threads is damaged during expansion, those threads cease to contribute to the transfer of applied loads between the male and female connection members. Therefore, when several threads are damaged, the engaged thread body is severely weakened. By maintaining a center section 225 between the opposing radii 205, 220, the change in forces brought about by the different radii is less damaging to the threads.

In addition to avoiding pressure spikes between radii, the center section permits design aspects of the tool to be easily changed. For example, lengthening the center section can permit the amount of radial expansion to be increased while maintaining a relatively small expansion angle. In a tool requiring a fixed expansion surface length, lengthening the center section results in reducing the size of the expansion radii 205, 220 while shortening the center section permits the radii to be enlarged. The ideal design is one that utilizes a center section that is long enough to provide the benefits of a neutral area but short enough to permit the expansion radii to maintain their relatively large and gradual shapes. In one example, a tool with an 8" expansion curve length has a center section of 0.031" with corresponding radii size of 39". Lengthening the center section to 2.0" results in a reduction of the radii to 36.5".

It is contemplated that the invention could include expansion radii of different size in some instances. For example, the convex expansion radius 220 could be made larger than the concave radius 205 in order to generate the second half of the expansion more gently for a certain metal seal configuration in an expandable connection. In this case, a center section between the two expansion radii will be especially important for minimizing spikes in contact pressure between the tool and the connection. In another embodiment, particularly useful in tools with longer center sections, a center configuration can be formed from two opposing and opposite radii in order to "spread" out the change in directions as the expansion surfaces are reversed between the concave 205 and convex 220 radii.

Because a tool of the present invention, with its optimized radius shapes results in a larger expansion surface than the prior art 10 degree cones, lubrication may be necessary to minimize heat and expansion force. In other cases, lubrication is necessary due to the material of a tubular. For example, a tubular made of steel with little or no iron, such as stainless steel is much more sensitive to galling or tearing than normal iron tubular grades. Additionally, these tubulars work harden more than normal casing grades. When additional lubrication is desired, the center section is an ideal location for the lubrication ports. In one instance, lubricating ports are drilled so that small openings are present at the surface of the center section allowing well fluids to be pumped between the tool and tubular or threaded connection. Preferably, these openings are formed longitudinally with respect to the centerline of tool and tubular rather than circumferentially, in order to decrease interruptions between the tool and tubular or connections that can cause spikes of contact pressure as they are expanded.

The most efficient port designs for keeping contact pressure spikes minimized are small, slotted openings along the center section length that are longitudinal or parallel with the tubular and tool axis. In one embodiment, the slots are approximately 0.050" wide to minimize circumferential discontinuity that can create problems a non-uniform expansion surface. Some systems rely upon a passage through the expansion cone to "seal cups" in front of the cone that isolate fluid. For such a system, lubricating holes can be formed between the fluid passageway inside the cone to the center section. In the case of cones that rely solely on force generated by fluid pressure behind the cones, the lubricating ports will require holes drilled from the back of the cone that extend directly to the center section.

Figure 7:
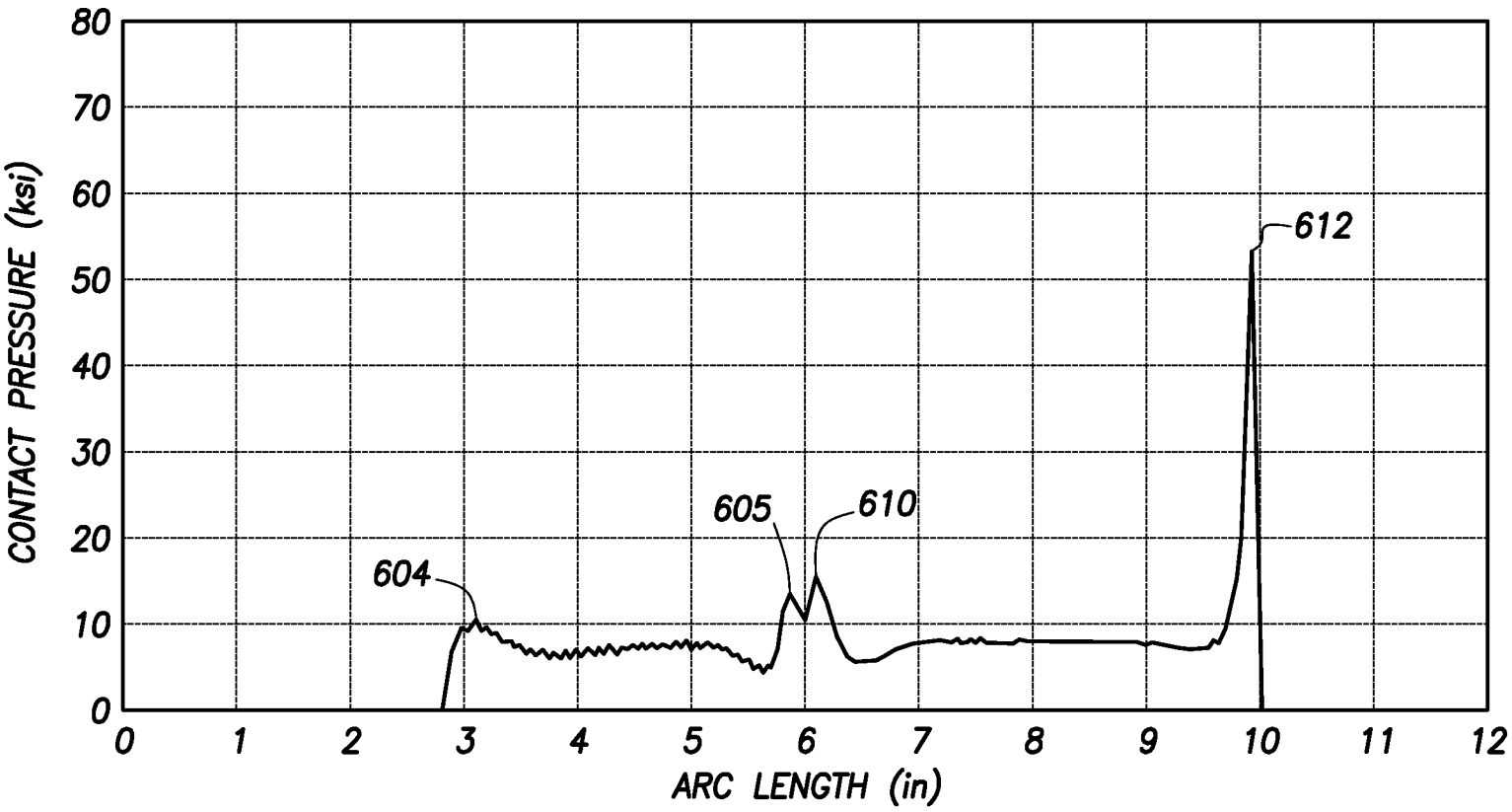
FIG. 7 is a graph showing contact pressures developed between a tubular and a tool without a convex tail surface.

As shown in FIG. 4, the tool includes a tail radius 255 at a trailing end of the tool that is designed to blend into the convex expansion radius 220 at a blend point 202 that is also the crown or largest outer diameter of the tool. Analyses have demonstrated that the optimum radius for the expansion radii is typically also optimum for the tail radius. Therefore, an optimum tail radius can be calculated using the same equation above (based upon wall thickness) as used for the optimum expansion radii. In the embodiment of FIG. 4, the tail radius is actually an extension of the convex expansion surface and serves to extend the arc length of the convex portion making it almost twice the length of the arc of the concave surface. The tail radius operates to complete expansion of the tubular or connection and then to gradually release the expanded part as it "springs back" as much as 1% as it leaves the crown 202 of the expansion tool 500. When expanding a threaded connection in a "pin-up" orientation, the pin nose metal seal region (157, FIG. 2) is the last part of a threaded connection to be contacted by the expansion tool. To avoid pressure spikes associated with the tool leaving the part, the tail radius 255 has a shape at a trailing end that is designed to mirror the shape of the part as it leaves the connection. FIG. 7 illustrates the importance of having an expansion tool with a tail portion designed to effectively manage the forces developed as the tool leaves the tubular or connection wall. The tool used to generate the graph of FIG. 7 includes the nose and expansion radii described herein and the relatively small spikes 604, 605, and 610 attest to the effectiveness of those shapes. However, the tail portion of the tool, with no radiused shape, produces a large spike that would most likely cause damage to a threaded connection resulting in a post-expansion result similar to the one shown in FIG. 3.

Figure 8:
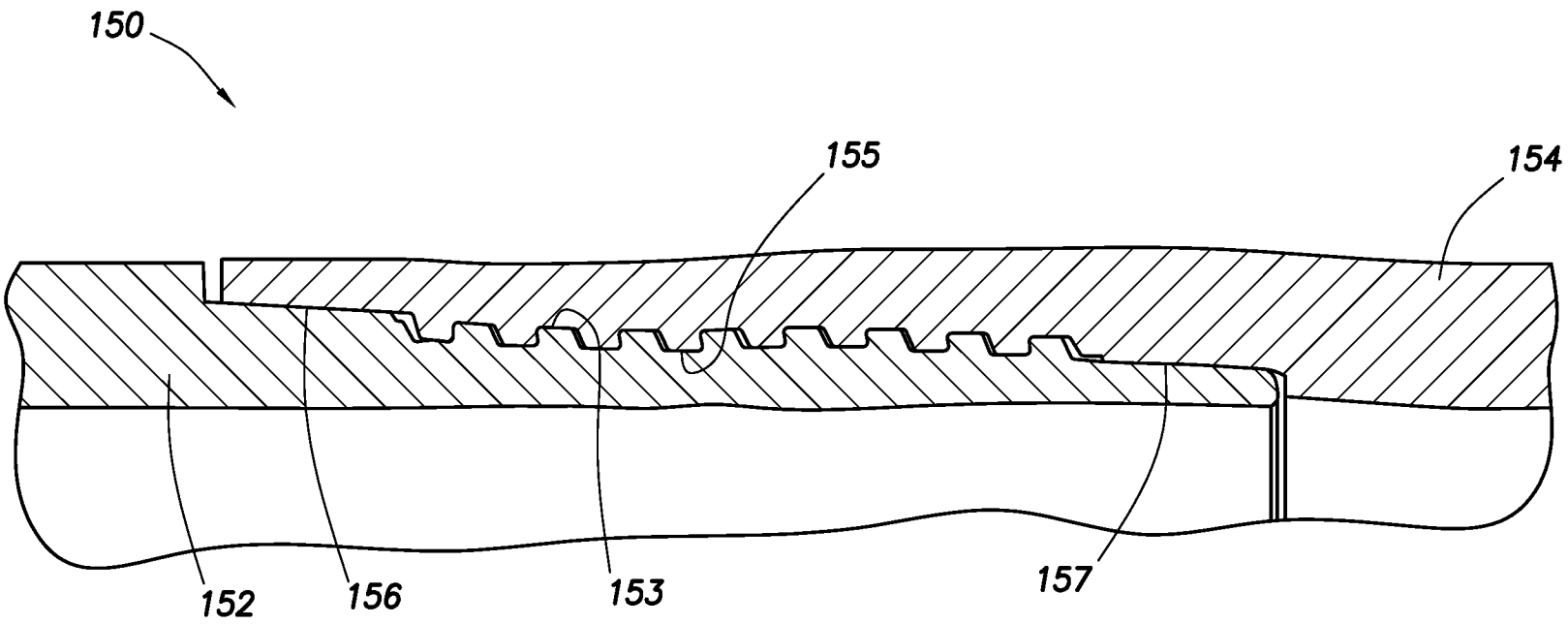
FIG. 8 is a section view showing the threaded connection of FIG. 2 after expansion with a tool having embodiments of the present invention.

FIG. 8 is a section view of a threaded connection 150 (like the one in FIG. 2) after expansion by a tool with aspects of the invention. For example, the tool producing the expanded connection in the Figure included a radiused nose portion and radiused expansion portions with a center portion therebetween. Additionally, the tool included a radiused tail portion like the one described and illustrated in FIG. 4. As is evident from the Figure, the threads 153, 155 between the pin 152 and box 154 members are largely intact and the metal seal areas 156, 157 are still in contact with each other. The result is a connection with metal to metal sealing surfaces that have retained almost all of their sealing ability.

Figure 9:
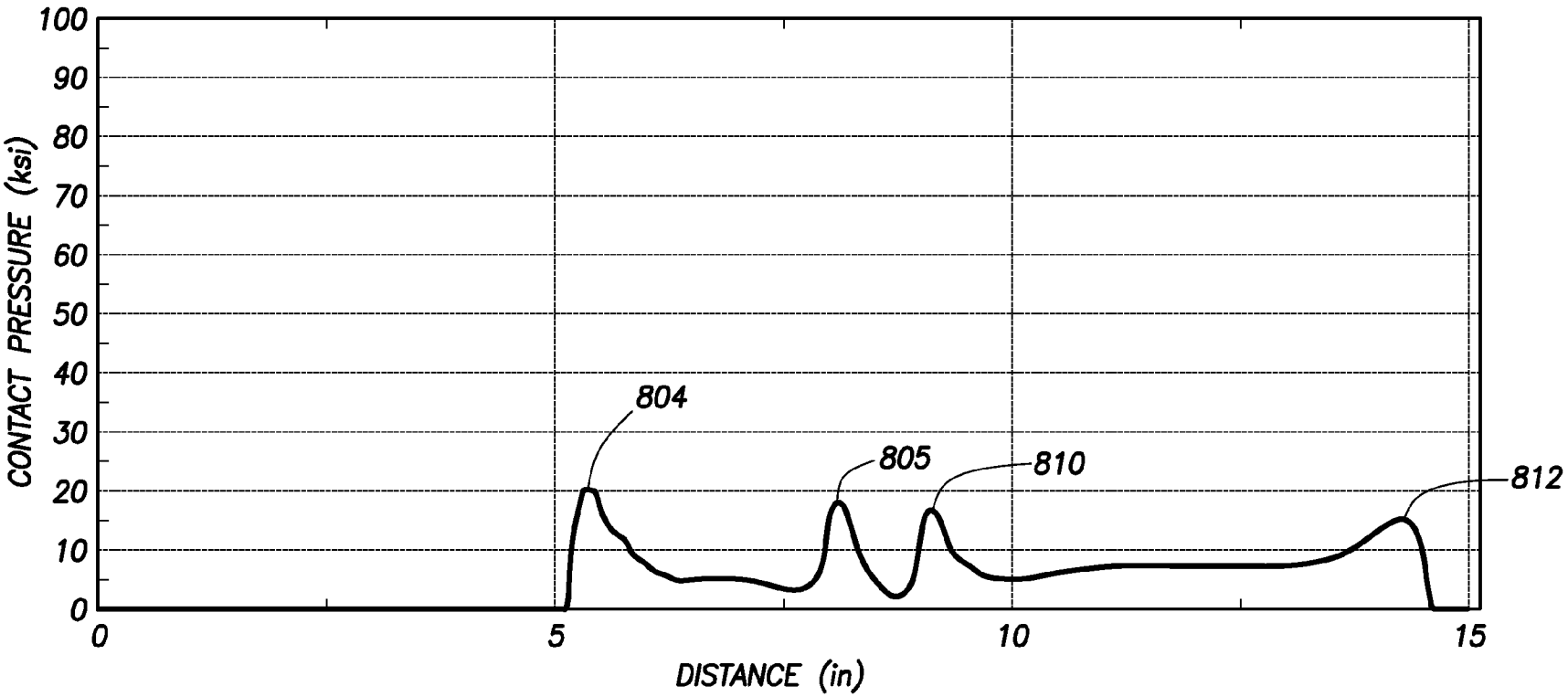
FIG. 9 is a graph illustrating contact pressures developed between an expansion tool of the invention with optimized, radiused expansion surfaces and a center section and a tubular.

FIG. 9 is a contact pressure graph generated by a tool having aspects of the present invention including optimized radiused expansion surfaces, 1" center section and tail radius. The tubular expanded to produce the graph was an 11¾" tubular having a 0.582" wall thickness. As the graph illustrates, nose radius portion of the tool creates a spike 804 of just over 20 ksi. Thereafter, instead of a large spike at the intersection of the two expansion radii (see FIG. 5) the center section of the tool essentially divides the spike of FIG. 5 into two equal and smaller spikes 805, 810. Finally, the tail radius produces another spike 812 as the wall of the tubular leaves the tool after expansion. As shown in FIG. 9, the tool having the features described herein including an expansion surface formed of optimized, radiused shapes, a center section, and tail radius expands the tubular while keeping the contact pressure at or below 20 ksi. The inventors have tested and modeled the tool's effect on threaded connections like the one shown in FIG. 2 and concluded that the sealing surfaces retain at least part of their sealing ability when the contact pressure are kept at or under 20 ksi.

Comparing the graph of FIG. 9 to the graph of FIG. 1 (or FIG. 5), it is apparent that the dual expansion radii tool expands a tubular (or a connection between tubulars) in a manner resulting in less contact pressure between the parts and therefore less axial bending. In addition, the contact pressure that is created is relatively consistent with no areas of high pressure and no area wherein the tool is completely out of contact with the part being expanded.

The actual design of a tool according to the present invention depends first on the wall thickness of the tubulars to be expanded. Using that wall thickness, the radius size is determined in inches using the formula disclosed herein. Thereafter, point 201 (FIG. 4) is set, typically determined by the smallest inner diameter of the connection. Thereafter, point 202 is set to ensure the expansion percentage is achieved and takes into account a certain amount of "spring back" (between 0.5% and 1%) brought about by differences in section thickness, the amount of expansion and characteristics of the tubular material, so that the tubular string springs back to the desired diameter. Thereafter, the ratio sizes, along with the center section, determine the arc length of each equal expansion radius, 205, 220. A tail radius is typically added according to the size dictated for the expansion radii.

In addition to the foregoing, the inventors have discovered a number of other advantages to the expansion tool. Expansion force, or that force needed to drive an expansion tool of a larger diameter through a tubular of a smaller diameter, is a product of friction, axial bending, and hoop stress. Friction is developed between the expansion surface of the tool and the tubular wall it contacts. Axial bending, as described herein, is the outward bending of the tubular walls as they are expanded and hoop stress is a circumferential stress as a result of internal expansion pressures. Prior art, 10 degree cones have a relatively small area of expansion surface that enables them to expand a tubular while generating an acceptable amount of expansion force (around 100,000 lbf. for 5½" tubulars and about 400,000 lbf. for 11¾" tubulars). In spite of the increased expansion surface areas, the tool of the invention requires no more expansion force than a prior art 10 degree cone due to a reduction in axial bending that compensates for any increase in friction between the expansion surface of the tool and the tubular wall.

Figure 10:
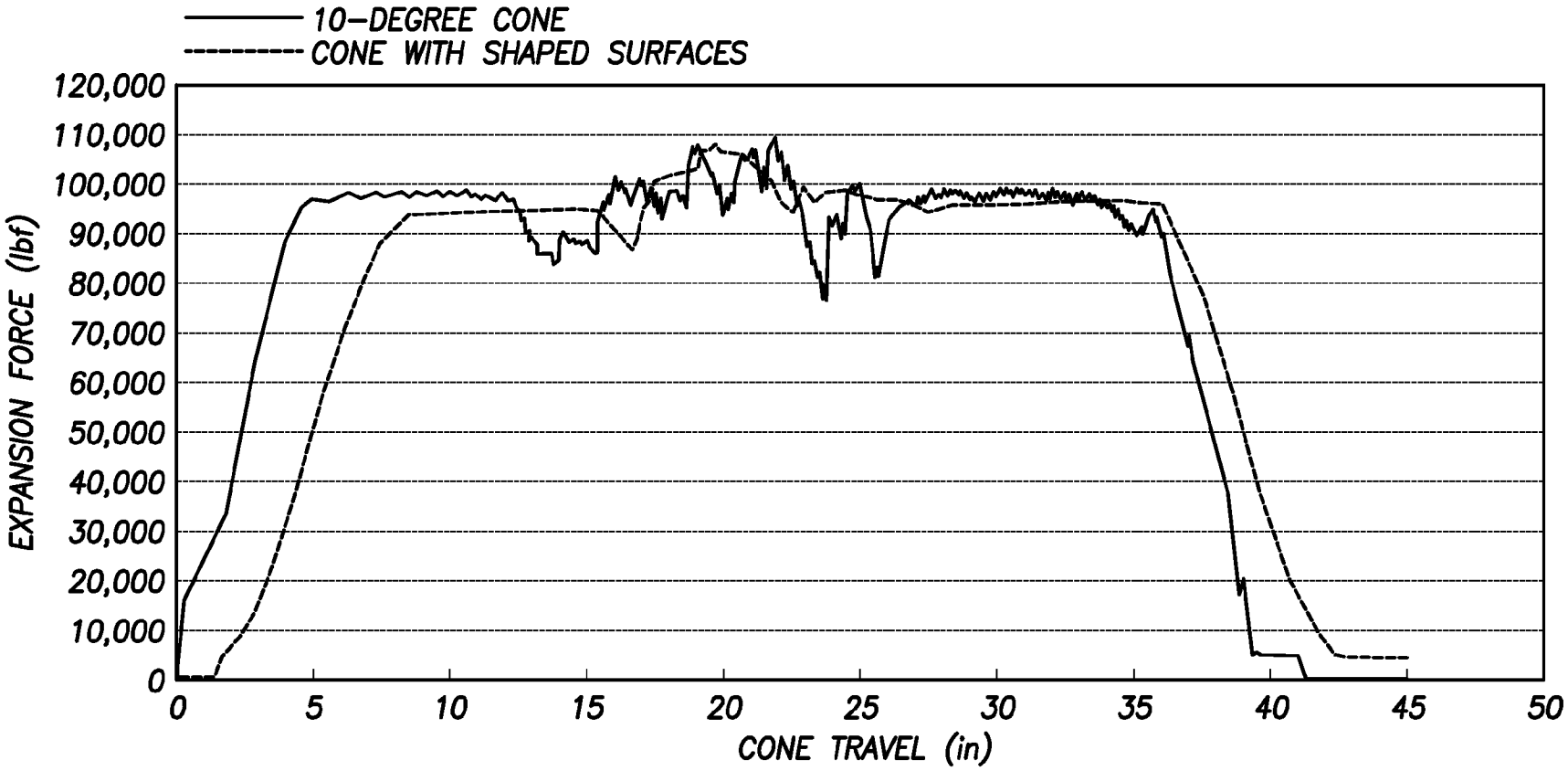
FIG. 10 is a graph showing a comparison in expansion forces between a prior art, 10 degree cone and an expansion tool of the present invention.

FIG. 10 is a graph showing a comparison of expansion force required by a prior art 10 degree cone and a tool of the present invention used to expand a 5½" tubular. The tool includes the radiused surfaces described herein and a center section between the expansion surfaces of 0.250". As is evident from the graph, both tools created very similar expansion force profiles as they each travel up to 45" through a tubular. The mid-portion of the graph shows the fluctuations in force that develop as a tool moves through a threaded connection. The results demonstrate that an expansion tool of the present invention, despite its relatively large expansion surface areas, requires no more expansion force than a prior art cone. In fact, the expansion tool of the invention produces a more stable force curve as it travels through a threaded connection.

Because the tool is necessarily longer than a standard 10 degree tool, the additional length results in improved alignment between the tool and the tubular or connection. With less "wobble" as the tool move axially, the tubular remains straighter than tubing expanded with a shorter, prior art tool.

The result is a tubular that is less prone to collapse prematurely due to an unsymmetrical shape when an external pressure is applied. Because expanded tubular is typically much softer than normal grades of casing, it can be more easily damaged. High contact pressures between the tubular or connection and the expansion tool are not only a sign of axial bending but can also be a source of damage to the material of the tubular. Damage like galling, tearing, smearing or other localized yielding can be detrimental to a tubular's materials strength integrity and resistance to corrosion and all can be reduced with an expansion tool that operates in more even manner and develops lower contact pressures. Additionally, because the tool's surfaces reduce the contact pressure during expansion, the tool itself will have a longer usable life with its various surfaces remaining in tolerance longer than a tool subjected to higher contact pressures. Also, because the shaped cone greatly reduces axial bending, flaws in the pipe that occur during its manufacture are less likely to propagate into a crack. Axial bending tends to open flaws that are oriented completely or even partially in the transverse direction (perpendicular to the tubular axis). Therefore, tubular specifications can be relaxed somewhat that will create a lower cost to the operators.

While the foregoing is directed to embodiments of the present invention, other and further embodiments of the invention may be devised without departing from the basic scope thereof, and the scope thereof is determined by the claims that follow. For example, the tool can be made and used in a variety of ways and still include the advantageous shapes described. The tool could be part of a larger assembly including remotely actuatable liners and hangers and could be made collapsible or of segments whereby the tool assumes its final diameter, including the radiused shapes, after being deployed in a wellbore. Collapsible cones are disclosed in U.S. Pat. No. 6,012,523 and that patent is incorporated herein by reference in its entirety. Additionally, multiple expansion tools or a single tool with additional, larger diameter expansion surfaces along its length can be used to enlarge a tubular in steps, resulting in an overall expansion of up to 30%. Multi-stage passes with prior art conical tools create a compounded amount of damage to a tubular or connection. The tool of the invention, however, produces no such compound damage.

The invention claimed is:

1. An expansion tool for expanding a tubular in a wellbore comprising:

a leading end having a first outer diameter smaller than an inside diameter of the tubular to be expanded in the wellbore;

an expansion surface including:

a concave portion extending from the leading end;

a curvilinear convex portion extending from the center section and including a portion of the tool having the largest outer diameter; and a straight center section extending from the concave portion, wherein the concave portion and convex portion are separated by the center section.

2. The expansion tool of claim 1, wherein the convex portion includes an arc length extending the convex portion to a trailing end of the tool.

3. The expansion tool of claim 2, wherein the concave and convex portions are substantially equal in size and arc length.

4. The expansion tool of claim 3, wherein the concave and convex portions are each tangent to the center section at one end.

5. The expansion tool of claim 1, wherein the concave and convex portions are radius-shaped.

6. The expansion tool of claim 1, wherein the center section is formed according to a formula $Y=(1.26)(X)-0.13$, where X is the wall thickness of a tubular and Y is the length of the center section.

7. The expansion tool of claim 1, further including a convex pilot radius formed at the leading end of the tool, the pilot radius adjacent to and tangent to the first concave portion.

8. The expansion tool of claim 1, wherein the expansion surface has an average angle of 3 degrees with respect to a vertical axis of the tool.

9. A method of expanding a tubular, comprising:

passing an expansion tool through the tubular in a wellbore, the expansion tool having a first outer diameter smaller than an inside diameter of the tubular;

an expansion surface including:

a concave portion extending from a leading end;

a curvilinear convex portion extending from a straight center section, wherein the concave portion and convex portion are separated by the center section; and including a portion of the tool having the largest outer diameter; and thereby expanding an inner diameter of the tubular.

10. The method of claim 9, further comprising:

expanding a threaded connection between a first tubular and second tubular.

11. An expansion tool for expanding a tubular in a wellbore comprising:

a leading end having a first outer diameter smaller than an inside diameter of the tubular to be expanded in the wellbore;

an expansion surface including:

a concave portion extending from the leading end;

a curvilinear convex portion extending from the center section and including a portion of the tool having the largest outer diameter, wherein the center section is formed according to a formula $Y=(1.26)(X)-0.13$, where X is the wall thickness of a tubular and Y is the length of the center section; and a straight center section extending from the concave portion, wherein the concave portion and convex portion are separated by the center section.

* * * * *